United States Patent [19]

Orr et al.

[11] 4,195,670

[45] Apr. 1, 1980

[54] REVERSIBLE BEATER REED FOR A WEAVING LOOM

[76] Inventors: Robert P. Orr; Joan B. Orr; Thomas P. Orr, all of 104 Main St., Tiburon, Calif. 94920

[21] Appl. No.: 15,128

[22] Filed: Feb. 26, 1979

Related U.S. Application Data

[62] Division of Ser. No. 884,165, Mar. 7, 1978, abandoned.

[51] Int. Cl.[2] ..... D03D 49/68

[52] U.S. Cl. ..... 139/192

[58] Field of Search ..... 139/192, 29, 30, 31, 139/32, 33

[56] References Cited

U.S. PATENT DOCUMENTS

| | | | |
|---|---|---|---|
| 2,166,415 | 7/1939 | Lervad | 139/33 |
| 2,437,716 | 3/1948 | Tiefenthal | 139/33 |
| 3,867,965 | 2/1975 | Hanson | 139/29 |

FOREIGN PATENT DOCUMENTS

| | | | |
|---|---|---|---|
| 72728 | 6/1945 | Norway | 139/29 |

*Primary Examiner*—Henry Jaudon

*Attorney, Agent, or Firm*—Owen, Wickersham & Erickson

[57] ABSTRACT

A beater reed with stub shafts projecting outwardly from its upper end for engagement in any of a series of notches in stanchions of a loom. The reed has a series of spaced-apart bars providing slots therebetween, each bar having a central opening through it. One side of the reed has flat coplanar bar surfaces, while the other side has an angularly extending vertex portion below each slot and each hole. The bar is reversible for use in either of two different types of beating.

1 Claim, 9 Drawing Figures

FIG. 3
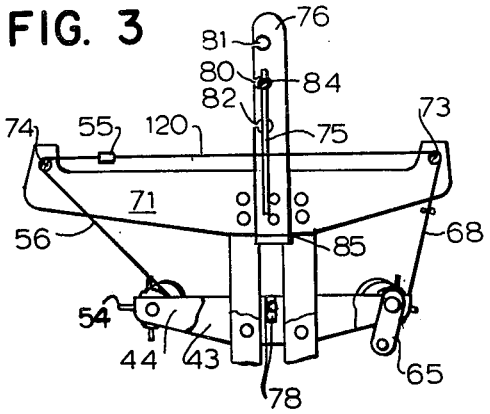
FIG. 4
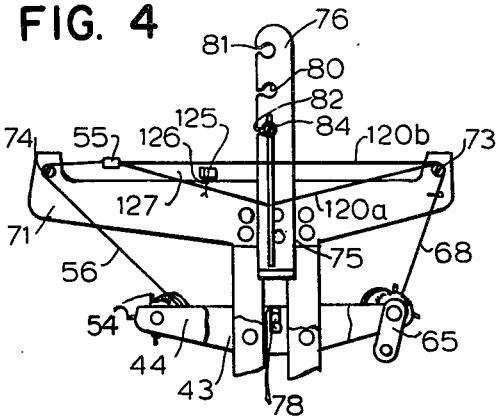
FIG. 5
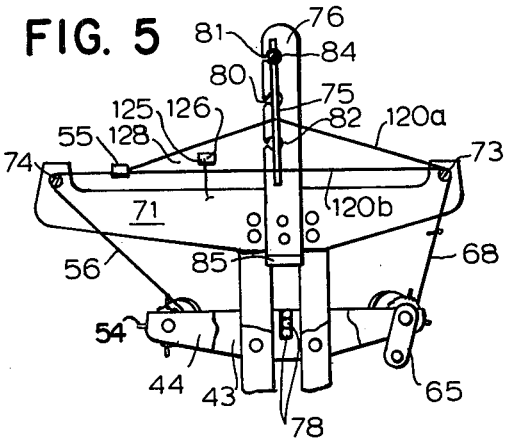
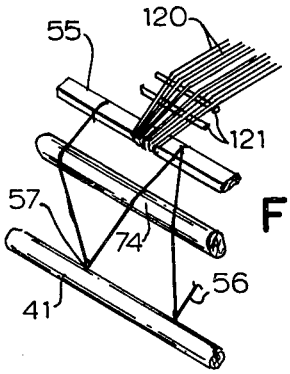
FIG. 6

REVERSIBLE BEATER REED FOR A WEAVING LOOM

This is a division, of application Ser. No. 884,165, filed Mar. 7, 1978 now abandoned.

BACKGROUND OF THE INVENTION

This invention relates to an improved reversible beater reed for a loom for artistic or craft weaving, for home or studio use, as distinct from the mechanical looms of factories.

A difficulty in setting up the warp in looms has been the threading of the beater reed itself, which has been always upright in most looms and has therefore required the weaver to work from an awkward position, often without being able to see well what is being done.

Another problem has been that the beater reed on such a loom has usually been capable of only one type of beating action, and this has limited the variety of types of packing or beating that the loom could do. If one needed a different type of beating action, one would have had to have another completely separate beater reed.

Thus, among the objects of the invention are those of greatly increased efficiency of warping and of setting up the warp through the beater reed.

Another object of the invention is to provide a more versatile beater reed and to provide for easy alternation of the warp rods with the beater reed.

SUMMARY OF THE INVENTION

A novel beater reed comprises a rectangular frame with stub shafts projecting outwardly therefrom at the upper end for engagement in any pair of notches of the stanchions after the warp rods are removed therefrom. Its reed portion comprises spaced-apart bars to provide vertical thread-receiving slots therebetween, and each bar has a single central thread opening therethrough. The stub shafts normally support said beater reed vertically in any pair of stanchion notches, but they are also engageable with the upper surface of the forward portions of the support members for a nearly horizontal support of the reed during threading of warp threads through its openings and slots, and their tying to the tie-up bar. During weaving the beater reed is alternated between the upper notches and the lower notches, with the beating action used each time the position is changed.

Other features, advantages, and objects of the invention will appear from the following description of a preferred embodiment.

BRIEF DESCRIPTION OF THE DRAWINGS

In the drawings:

FIG. 3 is a fragmentary view in side elevation of the upper portion of the loom showing some of the warp from the warp beam attached to the tie-up bar of the cloth beam and extending through the beater reed, with the beater reed set in the central notches so that all warp threads lie in a common plane.

FIG. 4 is a view similar to FIG. 3 with the beater reed set in the lowest notches to produce a lower shed.

FIG. 5 is a view similar to FIGS. 3 and 4 with the beater reed set in the highest notches to produce an upper shed.

FIG. 6 is a fragmentary isometric view of portions of the cloth beam, the breast beam, and the tie-up bar with some warp threads secured thereto and with tension-tightening dowel rods inserted through the warp.

DESCRIPTION OF A PREFERRED EMBODIMENT

Figure 2:
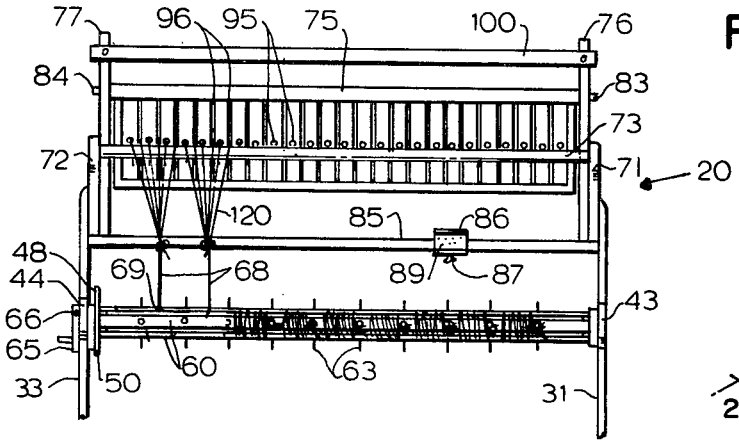
FIG. 2 is a view in rear elevation of the loom taken along the line 2—2 of FIG. 1.

The drawings show a loom 20 of a type useable with the beater reed of the invention. The loom 20 comprises a base assembly 21, a vertical support system 22, a mid-beam assembly 23, and a top-beam assembly 24. Each of these four basic assemblies is discussed in order.

Figure 1:
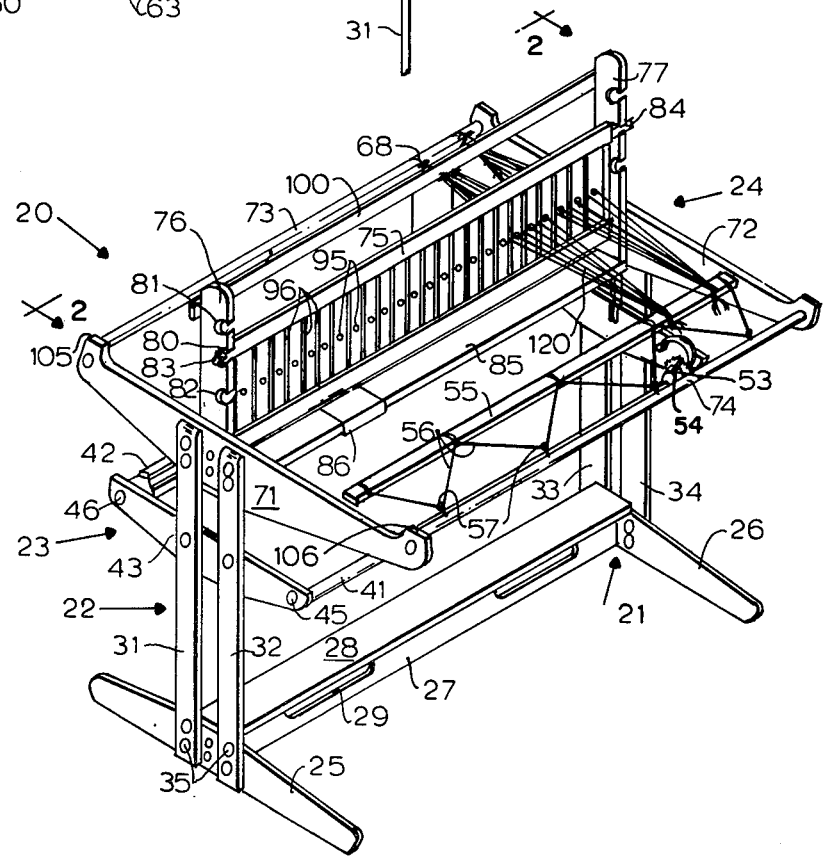
FIG. 1 is an isometric view of a beater reed embodying the principles of the invention, set up on a loom for weaving.

The base assembly 21 (FIG. 1)

A four-piece fixed base assembly 21 (FIG. 1) has a general "I" shape, and its bottom surfaces engage and rest on the floor, preferably carpeted, to prevent sliding or walking either sideways or front-to-back. If the bottom surfaces are coated with non-sliding material, such as rubber, the base assembly 21 will not walk on smooth surfaces, such as wood, tile, or concrete. The base assembly 21 comprises two asymmetrically-shaped side feet 25 and 26 to provide balance and stability to working forces when the loom is in operation. As will be seen, the loom 20 extends more to the front than to the back; so the feet 25 and 26 extend further from the putative transverse centerline to the front than to the rear. Two transverse base members 27 and 28 extend between the feet 25 and 26. The base members 27 and 28 are arranged in a T shape—the bottom piece 27 is vertical and the upper piece 28 is horizontal—to provide structural stiffness and to prevent racking of the base assembly 21. The base assembly 21 may be locked together with screws and glue. The vertical bottom piece 27 may have cutouts 29 to prevent an over-heavy base appearance as well as to reduce the actual weight. The shapes of the cutouts 29 preferably repeat the visual theme of the overall design.

The vertical support system 22 (FIG. 1, especially)

The vertical support system 22 of the loom 20 preferably comprises four vertical legs 31, 32, 33, and 34 secured to the feet 25 and 26 arranged two per side in a closely spaced, parallel position on each side of the working center plane of the loom 20. The legs provide the primary vertical structural support for the entire loom 20 as well as the main central connection element for the transversely positioned assemblies, i.e., the base assembly 21, the mid-beam assembly 23, and the top-beam assembly 24. Positioning the legs 31, 32, 33, and 34 approximately at an inward center plane provides as little as possible obstruction to the operations performed about the beams of the loom 20. Providing two legs per side (as opposed to one leg per side of equal width) reduces the overall weight of the loom 20 while achieving the same bolt spacing for the attached subassemblies, which helps to hold the loom 20 straight.

The legs 31, 32, 33, and 34 are connected to the feet 25 and 26 of the base assembly 21 and also to the other assemblies by fasteners 35. These fasteners 35 enable ready disassembly of the fixed subassemblies as well as periodic tightening, adjustment, and alignment, when required.

For maximum structural stiffness, with bracing front-to-back, a four-bolt pattern is used for attaching both the base and top assemblies 21 and 24. A two-bolt pattern is sufficient to attach the mid-beam assembly 23.

The mid-beam assembly 23 (FIGS. 1–5)

A mid-beam assembly 23 is comprised mainly of two rotating storage or operational beams 41 and 42 and two mid-beam supports 43 and 44. The cloth beam 41 and the sectional beam 42 rotate on stub shafts 45 and 46 which are mounted through the mid-beam support units 43 and 44. These units 43 and 44 support the entire subassembly 23 and are in turn bolted (as previously described) by fasteners 35 to the side legs 31, 32, 33, and 34 approximately midway between the top subassembly 24 and the base subassembly 21.

The mid-beam support units 43 and 44 are relatively short, so as to position both of the rotating beams 41 and 42 well inside the perimeter of the loom 20, thereby achieving compactness on the backside of the loom 20 and knee clearance for the cloth beam 41 on the front side. Along with providing bearing support for the two rotating beams 41 and 42, the mid-beam support units 43 and 44 provide a stable anchor on which pawls or dogs 48 are movably mounted for engagement, when desired, with ratchets, one of which is mounted on each beam 41 and 42. The pawl-ratchet combinations 48, 50 provide brakes or stops for the two beams 41 and 42. Also, each mid-beam support unit 43, 44 is provided with a central notch or groove so as to develop a resting or storage slot (between them) for the warp rods 78 when they are not in use, as discussed below.

The cloth beam 41

The cloth beam 41 is a rotating sotrage beam. It is located at the front of the loom 20, just in front of the weavers' knees with its working rotation clockwise—a rotation opposite in direction to that of the sectional warp beam 42 which it tensions the warp threads against. The cloth beam 41 has two primary purposes: first, to take up the woven material as it is finished and roll it up in a stored position until the entire finished material is removed from the loom 20, and, second, to provide an adjustable tension to the warp by means of a ratchet and a pawl at one end, the ratchet being mounted against a hub 53 with four handles 54. By using any one or more of the handles 54, the weaver can turn the beam 41 clockwise and can tighten the tension of the warp.

Attached to the cloth beam 41 at quarter points is a tie-up bar 55. The primary purpose of the bar 55 is to provide a readily accessible attachment point for the weaver to tie the warp to. The bar 55 is connected to the beam 41 by a heavy continuous cord 56 which runs through several eyes 57 on the cloth beam 41 and consequently is self-adjusting to various warp tensions, should a change in tension occur. Preferably, the cord 56 is installed to space the tie-up bar 55 about twenty inches from the beam 41, when the tie-up bar 55 is extended to the maximum. Also, the tie-up bar 55 provides a continuous surface to attach the warp to in a variety of combinations. For example, the warp threads can be grouped in as many as twelve threads per tie (for a fast tie-up), or six threads (recommended) or as few as two, which results in slow weaving but, in turn, produces a fine, even, start-up of the woven piece.

The sectional warp beam 42

The sectional warp beam 42, first, stores the warp thread, and second, dispenses the warp thread through the loom 20 with even tension. The sectional warp beam 42 is located in the rear of the loom 20, opposite and parallel to the cloth beam 41, and is mounted to the mid-beam supports 43 and 44 by the stub shafts 46.

Figure 9:
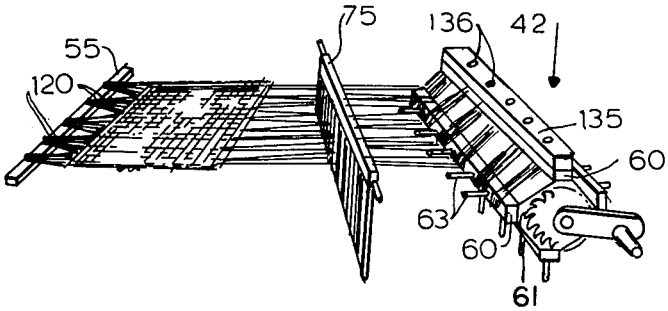
FIG. 9 is a view in perspective of a tie-up bar, warp beam, beater reed, and warp with a portion of the weft completed, being removed as a unit from the loom.

The sectional warp beam is relatively large in diameter as compared to the other beams on the loom 20 and is so constructed as to provide an easy, fast, method of measuring the warp thread as the loom 20 is warped, i.e., loaded. The beam 42 is preferably comprised of four rails 60 running parallel to the transverse centerline of the beam 42. These rails 60 are mounted out from the center on end drums 61 which also provide mountings for the stub shafts 46 and the ratchet wheel 50. In between the end drums 61 are support blocks 62 (See FIG. 9). The rails 60 are divided into sections (hence the name, "sectional beam") by specially shaped dowel pins 63, one of which projects outwardly from each rail 60 at the end of each section to provide four dowel pins 63 circumferentially in line at each section. Thus, if there are twenty sections, there will be nineteen such groups of dowel pins 63 or seventy-six dowel pins 63. The dowel pins 63 have outer ends that are both tapered and rounded to prevent any possibility of snagging the warp as it is put on the loom 20. Each section can be individually warped or loaded as opposed to warping the entire warp beam 42 at one time, and better control and more consistent tension is achieved. Also, lateral slipping of deeply stacked warp is eliminated, since the pins 63 provide sides for the warp to rest against—much like ends on a spool. These sections are designed to hold a regulated amount of warp thread, i.e., twelve threads per section. The sectional warp beam 42 is preferably built up in circumference to provide approximately ½ yard (18") per revolution. This becomes functional to measuring the amount of warp placed on the beam 42 for a weaving project: thus 2 revolutions = 1 yard, 20 revolutions = 10 yards, etc.

A handle 65 lies outside the perimeter plane of the loom and is secured to one of the end drums 61, as by a dowel 66. Preferably, this is the same drum 61 to which the ratchet wheel 50 is attached. The ratchet's pawl 48 is rotatably attached to the horizontal support member 44, and easy off-on positioning is provided by a rest pin which (when the pawl 48 is swung out of engagement with the ratchet 50) rests on top of the support member 44. When the pawl 48 engages a tooth of the ratchet 50 and when there is tension on the beam 42, the beam 42 is restrained from rotation in the tension-increasing direction.

Another feature of the sectional warp beam 42 is the use of a warp extension cord 68 in the center of each section, i.e., midway between each group of dowels 63, this location helping to achieve even warp. For this purpose, one rail 60 is drilled through normal to the radial direction and in the exact center of each section to provide an opening 69. Each extension cord 68 has a knot at one end; the other end is inserted through the opening 69 and the knot then bears up against the rail 60. The warp extension cords 68 are long enough to go about once around the outside of the beam 42, and its outer end may be looped. For storage, the loop may be placed over one of the dowel pins 63. By securing each extension cord 68 through the rail 60, with the knot being on the side wall of that rail 60 rather than on the top, there is no knot in the way to cause uneven tension of warp. The warp extension cords 68 provide an economical method of saving warp, in that they provide an extension to the end of the warp and allow for its total usage as it extends up and over the back beam 42 to the beater reed 75. Without these extensions the warp would be cut off at the sectional warp beam 42—thus losing about 1 yard (× 132 threads).

The top-beam assembly 24 (FIGS. 1–5)

The top-beam assembly 24 provides several important functions. It provides an horizontal working plane for the warp threads, provides a controlled system for separating the warp threads or for making a shed for control of woven pattern, provides vertical working positions for a beater reed when weaving and for warp rods when warping, and provides a total framework for the warp system, including racking spools, tensioning means for warp, and means for applying warp in predetermined numbers of threads onto the sectional beam. It also supports an accessory bar on which several attachments can be mounted.

The top-beam assembly 24 comprises two top-beam support members 71 and 72 which are secured to the legs 31, 32, 33, and 34 and are joined at their outer ends by two fixed, round beams 73 and 74, namely a back beam 73 and a breast beam 74. The stationary round beams 73 and 74 provide a horizontal plane on which to run the warp across and provide a smooth round surface over and around which the warp thread can be tensioned during the warping process without being cut or damaged.

The top-beam supports 71 and 72 which hold the beams 73 and 74 are bolted to the side legs 31, 32, 33, and 34 at an asymmetrical transverse "centerline", to provide more work space at the front of the loom 20 than at the back, so that the weaver can more easily see a large area of what has been woven, including the previous patterns, the colors, the yarns, and so on. Also, the supports 71 and 72 hold the beams 73 and 74 in such a position so as to align the upper surfaces of the beams 73 and 74 with openings through the center of a beater reed 75, when that is in its neutral position. Thus, the top support members 71 and 72 each have upturned ends 105, 106 that support the beams 73 and 74 on the same level, a level higher than the main upper surfaces of the members 71 and 72.

Notched stanchions 76 and 77 are secured to the top support members 71 and 72 and are used to position and support the beater reed 75 (FIGS. 1 and 2) at some times and, at other times, one or more warp rods 78. Each of the stanchions 76 and 77 has notches 80, 81, and 82 so constructed to easily receive stub shafts 83 and 84 on the ends of the beater reed 75 without sliding out under heavy warp tension. The notches 80, 81, and 82 are so spaced as to balance and to match the required effort necessary to move the beater reed 75 either up or down from a neutral position, as will be explained below. The neutral position (notches 80) places the beater reed 75 in the center of the warp plane; moving the beater reed 75 up to an upper position at notches 81 or down to a lower position at notches 82 results in a nominal 3-inch shed being developed in alternate groups of warp thread. The center notch 80 may be 2¾ inches below the upper notch 81 and 3 inches above the lower notch 82.

The server 86

The lower ends of the notched stanchions 76 and 77 are joined by a single server rail 85 which is parallel to the sectional warp beam 42 and spans between the two top-beam supports 71 and 72. On this rail 85 rides a warp server 86. The server 86 clamps completely around the rail 85 and can be slid or positioned at any point along the rail 85, for the full width of the loom 20. The server 86 has a thumbscrew 87 tapped through the bottom which enables the server 86 to be locked at any desired point. The server 86 has its top and two sides preferably made of wood, while its lower face is a server arm, preferably metal, which projects out from the base of the server 86 and has a turned-up portion 89 at the end. This portion 89 is drilled to provide two alternately spaced or staggered rows of holes, preferably six holes per row, so designed as to control the individual warp threads as they are fed as a group through the server 86 on to the sectional beam 42. This also enables a warp design or pattern to be repeated identically in each section of the sectional beam 42.

The warp rods 78

In cooperation with the server 86, three warp rods 78 may be used in the loom 20. They are positioned in the notches 80, 81, and 82 in the notched stanchions 76 and 77 when the beater reed 75 is removed, as when the warp is being stored on the warp beam 42. When not in use, the three rods 78 may be stored between the mid-beam supports 43 and 44 in slotted storage grooves as shown in FIGS. 3–5.

The beater reed 75 (FIGS. 1–5)

Figure 7:
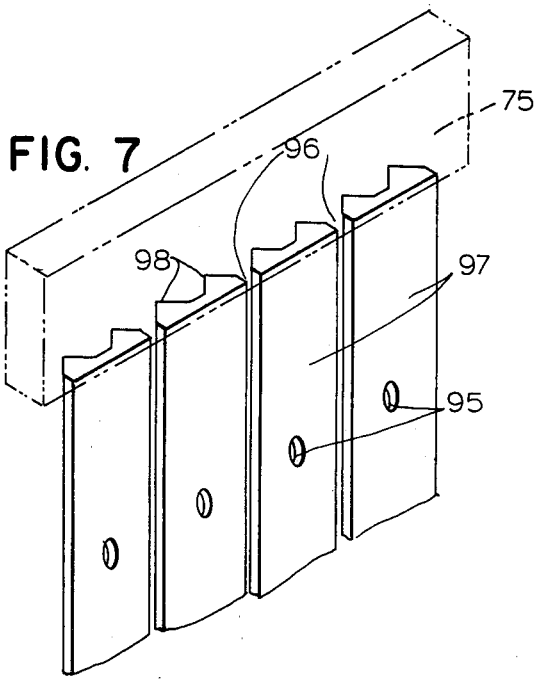
FIG. 7 is a fragmentary isometric enlarged view of a portion of the beater reed, with its upper frame member shown in phantom, to show the shape of one face of the beater reed.
Figure 8:
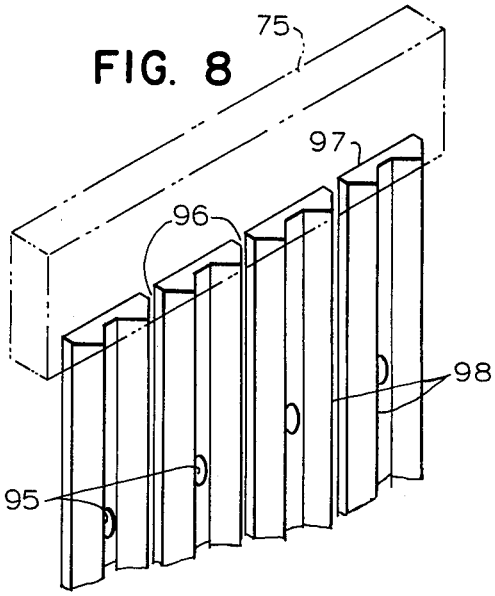
FIG. 8 is a similar view looking at the other face of the beater reed.

The beater reed 75, when installed as shown in FIGS. 7 and 8, is located between the notched stanchions 76 and 77, perpendicular to the warp plane which runs between the back beam 73 and the breast beam 74. The warp is threaded through the beater reed 75 in alternate holes 95 and slots 96 (See also FIGS. 7 and 8). When the beater reed 75 rests in the neutral notch 80 (FIG. 3) all the warp threads are on one level. When the beater reed 75 is raised into the upper notch 81 (FIG. 5), the warp threads in the holes 95 are elevated, producing a "shed", while the alternate warp threads in the slots 96 remain in the same horizontal plane. Then when the beater reed 75 is lowered to the lower position in the notches 82 (FIG. 4), again the warp threads in the holes 95 are lowered producing a second, lower shed. This is the basic operation of the reed 75. The term "beater" refers to beating or nesting the weft yarn into place by moving the reed 75 along the warp threads toward the breast beam 74 so as to produce a constant weave appearance. The harder the material is beaten the tighter or denser the fabric.

The bearer reed 75 of this invention is unique in that it is reversible and offers two types of surfaces for beating, as shown in FIGS. 7 and 8. First, a flat surface 97 (See FIG. 7) on one side of the reed 75 between the holes 95 and the slots 96 produces only moderate pressure on the individual weft yarn because of its relatively broad surface, hence an open woven pattern. Second, by reversing the beater reed 75, i.e., turning the backside forward, a second pattern will be produced, because this side has sharp wedge edges 98 (See FIG. 8)

between the slots 95 and holes 96 which pack the weft very closely, producing a dense, tightly woven fabric. Another feature of the beater reed 75 is that its stub shafts 83 and 84 are overlength, projecting out through the open ends of the notches 80, 81, or 82. This enables them to rest on the horizontal supports 71 and 72 during warping, with the reed 75 then substantially horizontal.

An accessory bar 100 is mounted to the backside of the noticed stanchions 76 and 77, out of the operational way of warping and weaving on the loom but strategically placed so as to provide a surface on which to attach accessories which collectively make the entire unit a weaving system rather than just a loom.

The Operation of Warping

1. Storing the warp threads

In warping, the loom is first set up with the warp rods 78 in place in the notches 80, 81 and 82. All three warp rods 78 are installed and where it is desired to use twelve threads per section, for example, four spools 93 of warping thread 120 are employed on each rod 78. The initial operation comprises getting the warp threads 120 onto the sectional warp beam 42.

The operation is continued until all sections of the sectional warp beam 42 are fully loaded with the warp thread 120. When the desired length of warp thread 120 is so reeled, the threads are cut off, pulled back through the server 86, put back on their spools, and the warp rods 78 and their spools 93, are removed from the loom 20. The spools 93 may be taken off the warp rods 78 and the warp rods 78 placed in the storage notches (See FIGS. 3–5).

2. Setting up the warp on the loom

Next, the beater reed 75 is to be threaded. Rather than installing it vertically in one of the pairs of notches, it may at this time be place substantially horizontally with its stub shafts 83 and 84 resting on the upper surface of the support members 71 and 72 and closer to the breast beam 74 than is the other edge of the beater reed 75. This gives full visibility to a worker sitting in front of the breast beam 74.

The weaver then reaches through to the warping beam 42 and takes all the threads 120 of one section, preferably, pulling them first up over the accessory bar 100, and then down to about even with the breast beam 74, in order to allow enough length. This is solely for measurement purposes, and the threads 120 of all sections are arranged in this way. He may then lock the sectional warp beam 42 in place by setting the pawl 48 into engagement with the ratchet wheel 50. Then the threading into the beater reed 75 begins, preferably starting in the center of the loom, alternately pulling a thread group back under the accessory bar 100 and threading the threads 120 for each section through the beater reed 75, so that one thread 120 goes through an opening 95, and the two threads 120 on either side of that go respectively into the slots 96 on each side of that opening 95 (See FIG. 1). The threading continues, with the slots 96 and openings 95 alternating and continuing out to each end. Each group of twelve threads, after being threaded through the beater reed 75, may then be tied to the tie-up bar 55, which at that stage is brought up from the cloth beam 41 and looped up over the breast beam 74 so that it lies fairly close to the breast beam 74.

The operation continues with the weaver attempting to obtain even tension on the tie-up bar 55. This can be done readily by feel and observation, first doing one of the central sections of thread and then the ones at each end and then alternating the groups back-and-forth until all of them have been threaded through the beater reed 75 and joined to the tie-up bar 55. After that, the beater reed 75 is installed vertically (See FIG. 4), with its stub shafts 83 and 84 resting in the lowest pair of notches 82, and then with a pawl set to engage the ratchet wheel on the beam 41, the handles 48 are used to tighten the tension on the warp to an amount just sufficient to tighten the tension on the warp to an amount just sufficient to lift the beater reed 75 so that its shafts 83 and 84 are carried up into contact with the upper edge of the notches 82. That gives a sufficient tension and can be judged to be about three clicks of the ratchet-pawl brake. The evenness of the tension is checked, and the operation is ready for actual weaving.

The Weaving Operation

With the warp threads 120 all in place and the beater reed 75 in the lowest position (FIG. 4), the operation may begin.

First, shed sticks may be inserted near the ends of the threads 120 where they are tied to the tie-up bar 55. This may be done by using shed sticks 121 (FIG. 6), as by placing the beater reed 75 in the lowest notches 82, inserting one shed stick 121, moving the beater reed 75 to the upper notches 81, and inserting another shed stick 121. Two shed sticks 121 are usually sufficient but another one may be used if desired. Then the actual weaving begins.

Many different types of weaving techniques may be used, and there is no need to describe them all. A simple type of operation, by which a tabby weave is obtained, will therefore be described. Yarn is previously put up onto hand shuttles 125 with different colored threads 126 or different sizes of threads on different shuttles 125, as desired by the weaver for his pattern. One end of a weft thread 126 on a shuttle 125 is placed slightly into the ends of the warp near the tie-up bar 55 for beginning the shuttle operation.

With the end of the thread in position and a sufficient additional length of thread unreeled from the shuttle 125, the shuttle 125 is passed through the shed 127 (FIG. 4) formed by the beater reed 75 preferably being in the lower pair of notches 82. In the shed 127, the threads **120*a* that go through the holes 95 are lower than the threads 120*b* that go through the notches 96. After the shuttle 125 has been passed through the shed 127, say from left to right, the beater reed 75 is removed from the lowest set of notches 81 and moved manually toward the weaver, combing the warp, and brought firmly up against the first pass of weft yarn 126, beating it up against the dowel rod 121. Then the beater reed 75 is raised and placed into the upper pair of notches 81, forming a shed 128 in which the warp threads 120*a* that pass through the holes 95 are higher than the threads 120*b* that pass through the notches 96. Some weft yarn 126 is unreeled from the shuttle 125, and then the shuttle 125 is passed back through the shed 128 leaving a pass of weft thread 126 in that direction. Once again, the beater reed 75 is removed from the notches 81, used to beat the latest pass of weft thread and then placed in the lowest pair of notches 82. Thus, the weaving is carried out with alternating the beater reed 75 from the upper notches 81, passing yarn through the warp, to beating, to the lower notches 82**, passing weft yarn through, beating, and so on.

Of course, many different kinds of weaves can be done and different arrangements can be made, some using skips or double rows, finger-generated patterns, and so on. As the operation continues cloth is formed until the space between the cloth and the beater reed 75 in its shed-forming position becomes smaller and smaller. Then, the weaver eases the tension on the warp by releasing the pawls from the ratchets and winds out some more warp from the warp beam 42. He then winds the cloth beam 41 to wind up some of the cord 56 around the beam 41, leaving the cloth end above the breast beam 74, with the tie-up bar 55 much closer to the cloth beam 41. He replaces both pawls in their respective ratchets, placing the beater reed 75 in the lower notches 82 rotates the cloth beam 41 to give the desired tension, indicated by lifting the beater reed's stub shafts 83 and 84 up to the tops of the notches 82. Weaving recommences. Soon, the tie-up bar 55 will have to be wound around the cloth beam 41 and cloth wound around it. The operation continues until the warp has been fully used or a desired length of cloth woven, most of which will have been wound on the cloth beam 41. Then the warp is cut, and the woven cloth, which is then on the cloth beam 41, removed.

To those skilled in the art to which this invention relates, many changes in construction and widely differing embodiments and applications of the invention will suggest themselves without departing from the spirit and scope of the invention. The disclosure and the description herein are purely illustrative and are not intended to be in any sense limiting.

We claim:

1. A reversible beater reed for a weaving loom, including in combination:

a frame having stub shafts projecting outwardly therefrom at the upper end, and a series of spaced-apart bars supported by said frame to provide slots therebetween, each bar having a central opening therethrough, one side of said reed having flat coplanar bar surfaces, the other side having each bar provided with a vertically extending wedge portion between each slot and each hole, for a different kind of beating.

* * * * *

UNITED STATES PATENT AND TRADEMARK OFFICE

CERTIFICATE OF CORRECTION

PATENT NO. : 4,195,670

DATED : April 1, 1980

INVENTOR(S) : Robert P. Orr, et al

It is certified that error appears in the above-identified patent and that said Letters Patent are hereby corrected as shown below:

Cover page, left hand column, item [62], Related U.S. Application Data, and Column 1, line 6, "abandoned" should read --Patent 4,154,267 issued May 15, 1979--.

Column 3, line 34, "ratchets," should read --ratchets 50,--.

Column 3, line 43, "sotrage" should read --storage--.

Column 7, line 9, "noticed" should read --notched--.

Column 9, line 14, "ratchets," should read --ratchets and,--.

Signed and Sealed this

*Fifteenth* Day of *July 1980*

[SEAL]

*Attest:*

SIDNEY A. DIAMOND

*Attesting Officer*

*Commissioner of Patents and Trademarks*